US012607071B2

(12) United States Patent
Gk et al.

(10) Patent No.: US 12,607,071 B2
(45) Date of Patent: Apr. 21, 2026

(54) EARTH-DRILLING TOOL

(71) Applicant: KENNAMETAL INDIA LIMITED, Bangalore (IN)

(72) Inventors: Nagesh Kumar Gk, Bangalore (IN); Mahesh Magadaiah, Bangalore (IN); Deepak S. Achar, Bangalore (IN); Prashanth Suresh, Bangalore (IN); Srihari Varma, Bangalore (IN); Balachandra Hegde, Bangalore (IN)

(73) Assignee: KENNAMETAL INDIA LTD., Bangalore (IN)

( * ) Notice: Subject to any disclaimer, the term of this patent is extended or adjusted under 35 U.S.C. 154(b) by 0 days.

(21) Appl. No.: 18/930,205

(22) Filed: Oct. 29, 2024

(65) Prior Publication Data

US 2025/0137328 A1 May 1, 2025

(30) Foreign Application Priority Data

Oct. 30, 2023 (IN) ..... 202341073745

(51) Int. Cl.
*E21B 10/38* (2006.01)
*E21B 10/43* (2006.01)
*E21B 10/56* (2006.01)

(52) U.S. Cl.
CPC ..... *E21B 10/38* (2013.01); *E21B 10/43* (2013.01); *E21B 10/56* (2013.01)

(58) Field of Classification Search
None
See application file for complete search history.

(56) References Cited

U.S. PATENT DOCUMENTS

| | | | | |
|---|---|---|---|---|
| 4,296,825 | A | 10/1981 | Larsson | |
| 4,771,834 | A | 9/1988 | Treitz | |
| 5,794,728 | A * | 8/1998 | Palmberg | E21B 10/56 175/418 |
| 6,039,127 | A | 3/2000 | Myers | |
| D705,827 | S | 5/2014 | Hammargren et al. | |
| D861,051 | S | 9/2019 | Koskinen | |
| 12,385,325 | B2 * | 8/2025 | Clark | E21B 10/42 |
| 2005/0161264 | A1 | 7/2005 | Bjork | |

(Continued)

FOREIGN PATENT DOCUMENTS

| | | |
|---|---|---|
| DE | 2733300 A1 | 2/1979 |
| GB | 2516626 A | 2/2015 |

(Continued)

*Primary Examiner* — Blake Michener
(74) *Attorney, Agent, or Firm* — Christopher J. Owens

(57) ABSTRACT

A drill-bit may include a head which includes a face and a gage. The face may include a plurality of face button bits. The gage may include a plurality of gage button bits evenly spaced around the head. A plurality of major chip gage gashes may be evenly spaced around the head. A plurality of minor chip gage gashes may be evenly spaced around the head. An axis extending through centers of the plurality of face button bits may extend through one of the plurality of major chip gage gashes and one of the plurality of minor chip gage gashes. The plurality of major chip gage gashes may alternate with the plurality of minor chip gage gashes around the head. One of the plurality of gage button bits may be disposed in-between every set of the alternating major chip gage gashes and minor chip gage gashes.

20 Claims, 4 Drawing Sheets

(56) References Cited

U.S. PATENT DOCUMENTS

| | | | | |
|---|---|---|---|---|
| 2006/0060389 | A1 | 3/2006 | Hadin et al. | |
| 2012/0138367 | A1 | 6/2012 | Carlsson et al. | |
| 2012/0325558 | A1 | 12/2012 | Lundberg et al. | |
| 2013/0180784 | A1 | 7/2013 | Esko et al. | |
| 2014/0299388 | A1* | 10/2014 | Rindeskar | E21B 10/5673 175/430 |
| 2015/0041223 | A1 | 2/2015 | Larsson | |
| 2016/0069134 | A1 | 3/2016 | Carlsson | |
| 2016/0130879 | A1 | 5/2016 | Gylling | |
| 2016/0348442 | A1 | 12/2016 | Rindeskar et al. | |
| 2017/0268295 | A1 | 9/2017 | Rindeskär | |
| 2021/0189804 | A1 | 6/2021 | Ries et al. | |
| 2021/0238927 | A1 | 8/2021 | Hammargren et al. | |

FOREIGN PATENT DOCUMENTS

| | | | | |
|---|---|---|---|---|
| RU | 2759137 | C1 | 11/2021 | |
| WO | WO-2017087781 | A1 * | 5/2017 | C22C 1/1073 |
| WO | 2020043505 | A1 | 3/2020 | |
| WO | 2022043246 | A1 | 3/2022 | |
| WO | 2022091865 | A1 | 5/2022 | |

* cited by examiner

EARTH-DRILLING TOOL

RELATED APPLICATION DATA

The present application claims priority pursuant to 35 U.S.C. § 119(a) to Indian Patent Application Number 202341073745 filed Oct. 30, 2023, which is incorporated herein by reference in its entirety.

FIELD OF THE DISCLOSURE

The disclosure relates to tools, such as drill-bits, which may be used to cut hard materials such as during earth-drilling.

BACKGROUND

Drilling tools, such as drill-bits, may be used to drill hard materials such as granite or other earth materials. Due to the hardness of the material being drilled, these drilling tools may experience issues with jamming, an uneven flow of cut-material, or may prematurely wear.

A drilling tool, and method of its use, is needed which may reduce one or more issues associated with one or more conventional drilling tools.

SUMMARY

In one embodiment, a drill-bit may include a head which includes a face and a gage. The face may include a plurality of face button bits. The gage may include a plurality of gage button bits evenly spaced around the head. A plurality of major chip gage gashes may be evenly spaced around the head. A plurality of minor chip gage gashes may be evenly spaced around the head. An axis extending through centers of the plurality of face button bits may extend through one of the plurality of major chip gage gashes and one of the plurality of minor chip gage gashes. The plurality of major chip gage gashes may alternate with the plurality of minor chip gage gashes around the head. One of the plurality of gage button bits may be disposed in-between every set of the alternating major chip gage gashes and minor chip gage gashes.

In another embodiment, a drill-bit may include a head which includes a face and a gage. The face may include a plurality of face button bits. The gage may include a plurality of gage button bits evenly spaced around the head. A plurality of major chip gage gashes may be evenly spaced around the head. A plurality of minor chip gage gashes may be evenly spaced around the head. The plurality of major chip gage gashes may alternate with the plurality of minor chip gage gashes around the head. One of the plurality of gage button bits may be disposed in-between every set of the alternating major chip gage gashes and minor chip gage gashes. A first axis extending through centers of the plurality of face flushing holes may be perpendicular to a second axis extending through centers of the plurality of gage flushing holes.

In still another embodiment, a method of using a drill-bit may be provided. In one step, the drill-bit may be rotated to cut material with a plurality of face button bits and a plurality of gage button bits. The plurality of gage button bits may be evenly spaced around a head of the drill-bit. In another step, air may be flowed through a plurality of face flushing holes and through a plurality of gage flushing holes. In yet another step, the material cut by the drill-bit may be flushed through a plurality of major chip gage gashes evenly spaced around the head, and through a plurality of minor chip gage gashes evenly spaced around the head. The plurality of major chip gage gashes may alternate with the plurality of minor chip gage gashes around the head. One of the plurality of gage button bits may be disposed in-between every set of the alternating major chip gage gashes and minor chip gage gashes. A first axis extending through centers of the plurality of face flushing holes may be perpendicular to a second axis extending through centers of the plurality of gage flushing holes.

The scope of the present disclosure is defined solely by the appended claims and is not affected by the statements within this summary.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DETAILED DESCRIPTION

Figure 1:
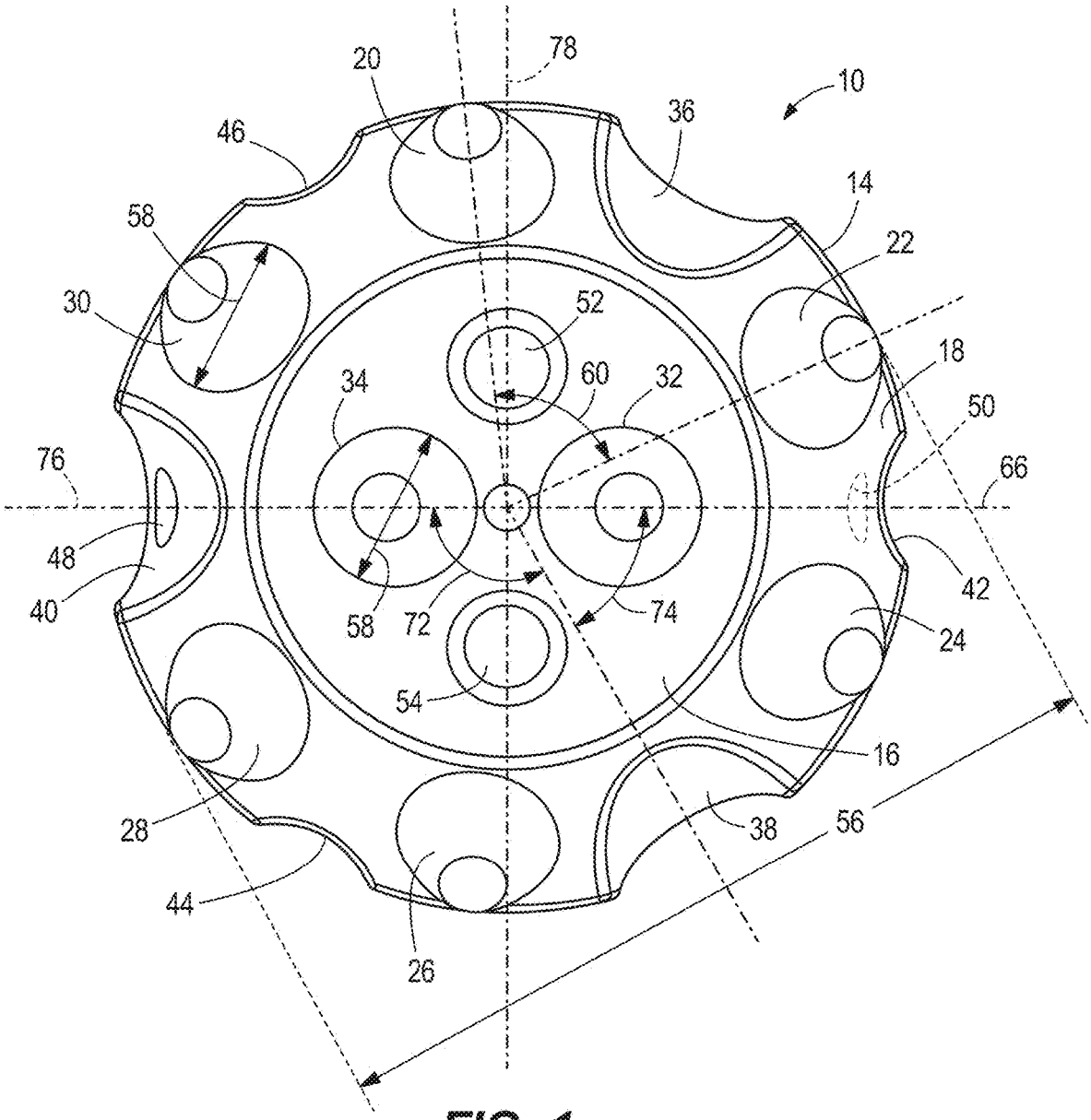
FIG. 1 illustrates a top view of one embodiment of a drill-bit.

Before one embodiment of the disclosure is explained in detail, it is to be understood that the disclosure is not limited in its application to the details of the construction and the arrangements of components set forth in the following description or illustrated in the drawings. The present disclosure is capable of other embodiments and of being practiced or being carried out in various ways. Also, it is to be understood that the phraseology and terminology used herein is for the purpose of description and should not be regarded as limiting. The use of "including," "comprising," or "having" and variations thereof as used herein is meant to encompass the items listed thereafter and equivalents thereof as well as additional items. The use of "consisting of" and variations thereof as used herein is meant to encompass only the items listed thereafter and equivalents thereof.

Figure 2:
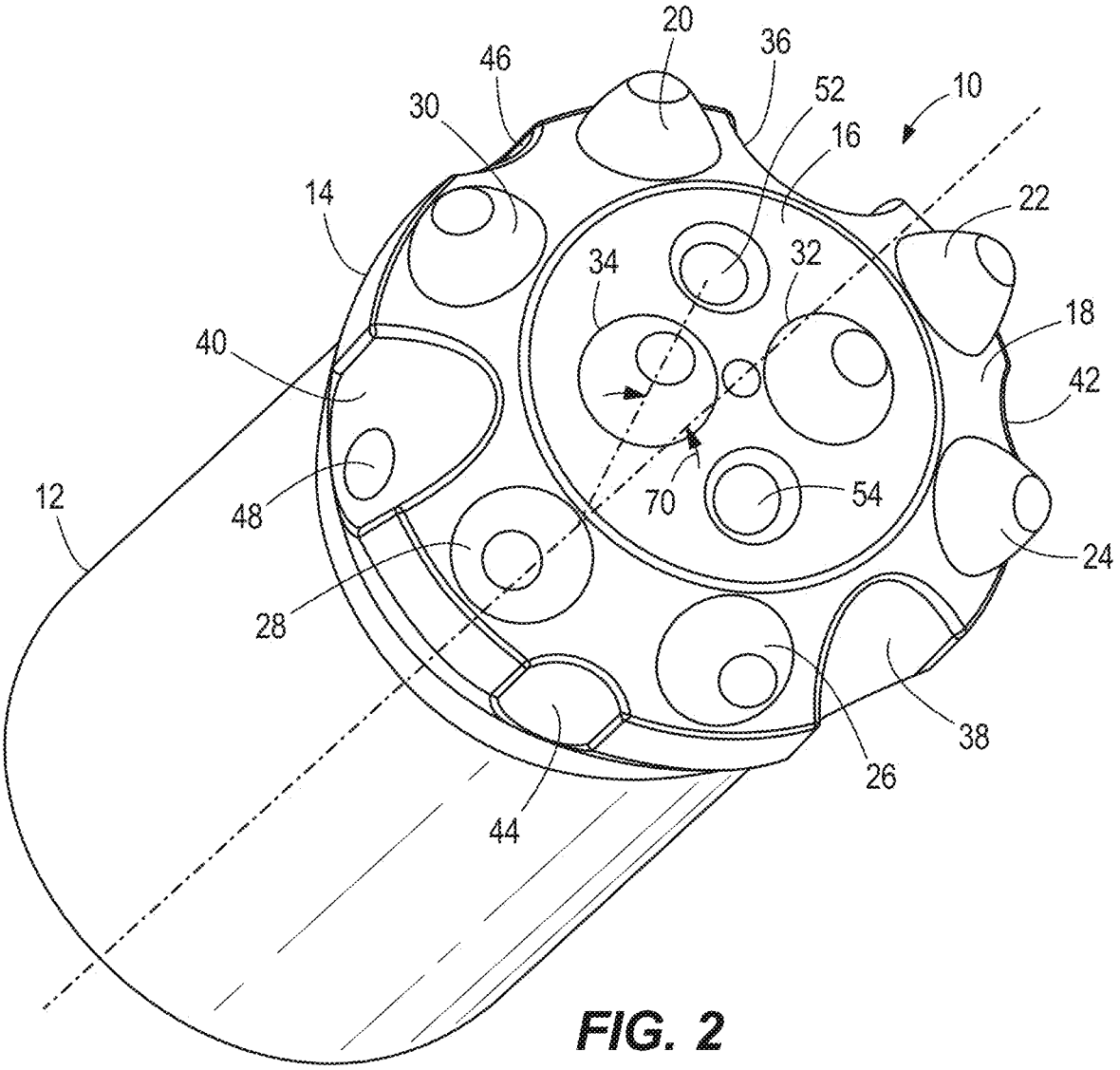
FIG. 2 illustrates a side perspective view of the drill-bit of FIG. 1.
Figure 3:
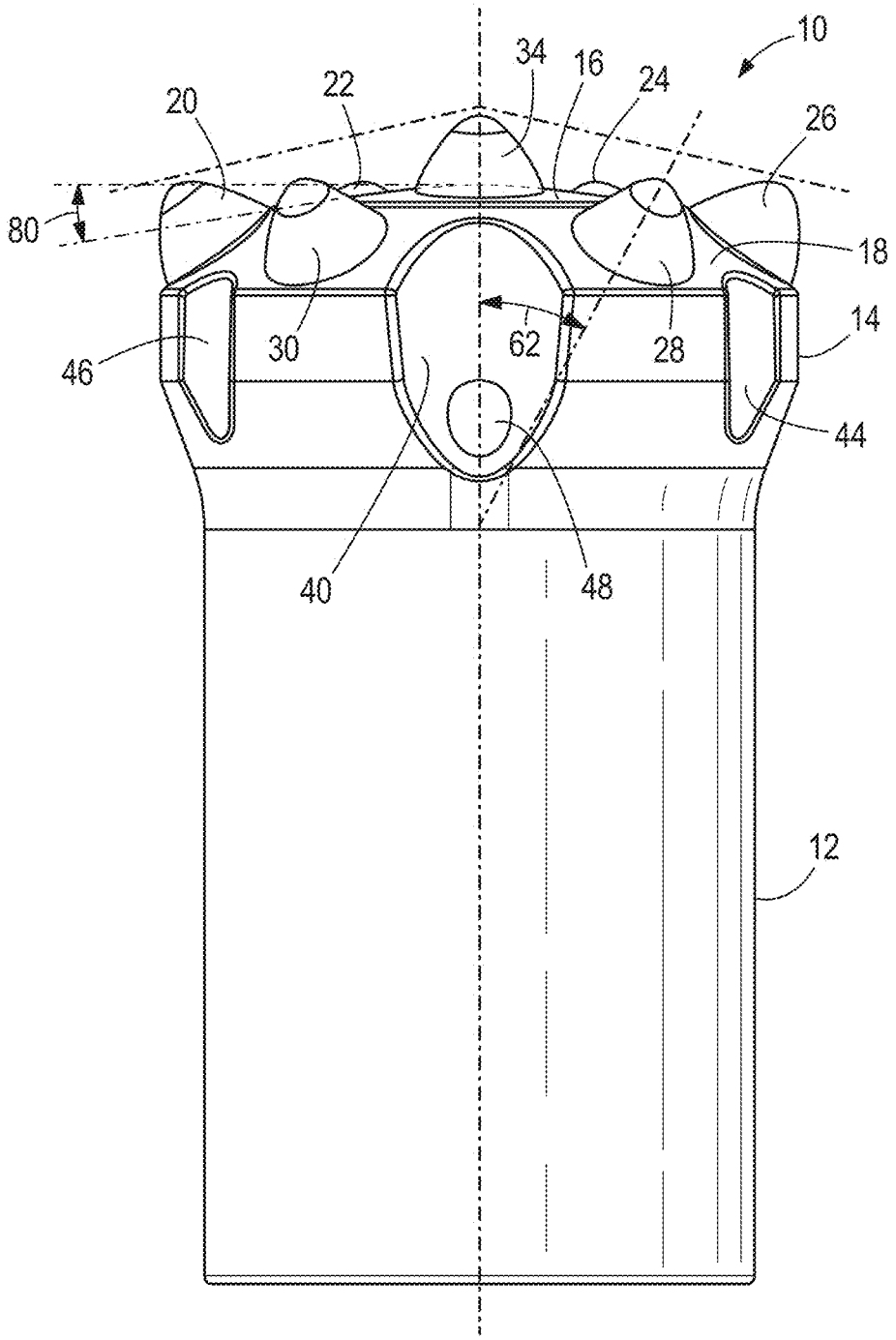
FIG. 3 illustrates a side view of the drill-bit of FIG. 1.

As illustrated in FIGS. 1-3 collectively, in one embodiment a drill bit 10 may comprise a shaft 12, a head 14, a face 16, a gage 18, six gage button bits 20, 22, 24, 26, 28, and 30, two face button bits 32 and 34, three major chip gage gashes 36, 38, and 40, three minor chip gage gashes 42, 44, and 46, two gage flushing holes 48 and 50, and two face flushing holes 52 and 54. The drill bit 10 may comprise a percussion rock drill bit which may be used to cut granite. In other embodiments, the drill bit 10 may be of varying types and may be used to cut differing rock or earth materials. The six gage button bits 20, 22, 24, 26, 28, and 30 and two face button bits 32 and 34 may be made of carbide. In other embodiments, the six gage button bits 20, 22, 24, 26, 28, and 30, and two face button bits 32 and 34 may be made of varying materials.

In one embodiment, the cutting diameter 56 of the drill bit 10 may be 34 millimeters. In other embodiments, the cutting diameter 56 of the drill bit 10 may be in a range of 33 millimeters-38 millimeters. In still other embodiments, the cutting diameter 56 of the drill bit 10 may vary. The diameters 58 of the six gage button bits 20, 22, 24, 26, 28, and 30 and two face button bits 32 and 34 may be in a range of 6 millimeters-8 millimeters. In other embodiments, the diameters 58 of the six gage button bits 20, 22, 24, 26, 28, and 30 and two face button bits 32 and 34 may vary.

Each of the six gage button bits 20, 22, 24, 26, 28, and 30 may be disposed between one of the major chip gage gashes 36, 38, and 40 and one of the minor chip gage gashes 42, 44, and 46. In other embodiments, each of the six gage button bits 20, 22, 24, 26, 28, and 30 may be disposed in varying configurations relative to the major chip gage gashes 36, 38, and 40 and minor chip gage gashes 42, 44, and 46. The angle 60 extending between the center of the face 16 and the centers of every two gage button bits 20, 22, 24, 26, 28, and 30 on either side of each of the major chip gage gashes 36, 38, and 40 may range between 66° to 78°. In other embodiments, the angle 60 extending between the center of the face 16 and the centers of every two gage button bits 20, 22, 24, 26, 28, and 30 on either side of each of the major chip gage gashes 36, 38, and 40 may vary. Each of the six gage button bits 20, 22, 24, 26, 28, and 30 may be press-fit perpendicular to the gage 18 so that their respective longitudinal axis is disposed at an angle 62 relative to a longitudinal center axis 64 through the drill bit 10 in a range of 32° to 42°. In other embodiments, each of the six gage button bits 20, 22, 24, 26, 28, and 30 may be attached in varying ways to the gage 18 so that their respective longitudinal axis is disposed at a varying angle 62 relative to the longitudinal center axis 64 through the drill bit 10.

An axis 66 extending through both centers of the two face button bits 32 and 34 may be disposed through the center of one of the major chip gage gashes 36, 38, and 40 and through the center of one of the minor chip gage gashes 42, 44, and 46. The two face button bits 32 and 34 may each be press-fit perpendicular to the face 16 so that their respective longitudinal axis is disposed at an angle 70 relative to the longitudinal center axis through the drill bit 10 in a range of 0° to 13°. In other embodiments, the two face button bits 32 and 34 may each be attached in varying ways to the face 16 so that their respective longitudinal axis is disposed at a varying angle 70 relative to the longitudinal center axis through the drill bit 10.

The three major chip gage gashes 36, 38, and 40 may be each equally spaced apart on the gage 18. The three minor chip gage gashes 42, 44, and 46 may also each be equally spaced apart on the gage 18. The three major chip gage gashes 36, 38, and 40 and the three minor chip gage gashes 42, 44, and 46 may improve flow of swarf (i.e. cut material such as drilled rock particles) being cut by the six gage button bits 20, 22, 24, 26, 28, and 30 and two face button bits 32 and 34. The angle 72 extending between the center of the face 16 and the centers of every two adjacent major chip gage gashes 36, 38, and 40 on opposite sides of each minor chip gage gashes 42, 44, and 46 may range between 115° to 125°. In other embodiments, the angle 72 extending between the center of the face 16 and the centers of every two adjacent major chip gage gashes 36, 38, and 40 on opposite sides of each minor chip gage gashes 42, 44, and 46 may vary. The angle 74 extending between the center of the face 16 and the centers of adjacent major chip gage gashes 36, 38, and 40 and minor chip gage gashes 42, 44, and 46 may range between 57° to 63°. In other embodiments, the angle 74 extending between the center of the face 16 and the centers of adjacent major chip gage gashes 36, 38, and 40 and minor chip gage gashes 42, 44, and 46 may vary.

Each of the adjacent gage and face flushing holes 48, 50, 52, and 54 may be spaced 90° apart relative to a center of the face 16. In other embodiments, each of the adjacent gage and face flushing holes 48, 50, 52, and 54 may be spaced at varying angles relative to the center of the face 16. An axis 76 extending through centers of the two gage flushing holes 48 and 50 may be perpendicular to an axis 78 extending through centers of the two face flushing holes 52 and 54. In other embodiments, the axis 76 extending through centers of the two gage flushing holes 48 and 50 may be at varying angles relative to the axis 78 extending through centers of the two face flushing holes 52 and 54. For every quarter rotation of the drill bit 10, the flushing air emitted from the gage and face flushing holes 48, 50, 52, and 54 may cover 360°. The flushing air emitted by the gage and face flushing holes 48, 50, 52, and 54 may push the swarf being cut by the six gage button bits 20, 22, 24, 26, 28, and 30 and the two face button bits 32 and 34 away from the head 14. In other embodiments, for every quarter rotation of the drill bit 10, the flushing air emitted from the gage and face flushing holes 48, 50, 52, and 54 may cover a varying number of degrees.

The axis 66 extending through both centers of the two face button bits 32 and 34 may be in a range of 80° to 100° relative to the axis 78 extending through centers of the two face flushing holes 52 and 54. In other embodiments, the axis 66 extending through both centers of the two face button bits 32 and 34 may vary in angle relative to the axis 78 extending through centers of the two face flushing holes 52 and 54. The axis 76 extending through centers of the two gage flushing holes 48 and 50 may be in-line (i.e. coincide) to the axis 66 extending through centers of the two face button bits 32 and 34. In other embodiments, the axis 76 extending through centers of the two gage flushing holes 48 and 50 may vary in position relative to the axis 66 extending through centers of the two face button bits 32 and 34. One of the two gage flushing holes 48 and 50 may be located in one of the three major chip gage gashes 36, 38, and 40 and the other of the two gage flushing holes 48 and 50 may be located in one of the three minor chip gage gashes 42, 44, and 46. In other embodiments, the two gage flushing holes 48 and 50 may be located in varying positions relative to the three major chip gage gashes 36, 38, and 40 and the three minor chip gage gashes 42, 44, and 46.

Two of the six gage button bits 20, 22, 24, 26, 28, and 30 may be disposed between each two adjacent major chip gage gashes 36, 38, and 40. In other embodiments, varying numbers of the six gage button bits may be disposed between each two adjacent major chip gage gashes 36, 38, and 40. One of the three minor chip gage gashes 42, 44, and 46 may be disposed between every two adjacent gage button bits 20, 22, 24, 26, 28, and 30. In other embodiments, varying number of minor chip gage gashes 42, 44, and 46 may be disposed between every two adjacent gage button bits 20, 22, 24, 26, 28, and 30.

A slope of the face 16 may be at an angle 80 ranging from 0° to 13° relative to a lateral axis of the drill bit 10. This configuration along with the placement of the six gage button bits 20, 22, 24, 26, 28, and 30 and two face button bits 32 and 34 may speed up the drilling process with higher penetration which is of particular benefit in hard rock applications. In other embodiments, the slope of the face 16 may be at varying angles 80 relative to the lateral axis of the drill bit 10.

The placement of the six gage button bits 20, 22, 24, 26, 28, and 30, two face button bits 32 and 34, three major chip gage gashes 36, 38, and 40, three minor chip gage gashes 42, 44, and 46, two gage flushing holes 48 and 50, and two face flushing holes 52 and 54 may cause swarf cut by the six gage button bits 20, 22, 24, 26, 28, and 30 and two face button bits 32 and 34 to get flushed away from the head 14. The design may cause the swarf to be uniform and may avoid the swarf from jamming which may enhance the life of both the drill bit 10 and the rod (not shown) driving the drill bit 10 without breakage. The design may also reduce heat generation which may reduce the frequency and likelihood of the drill bit 10 and the rod (not shown) driving the drill bit 10 breaking. In other embodiments, one or more components of the drill bit 10 may vary in size, location, number, and/or configuration.

Figure 4:
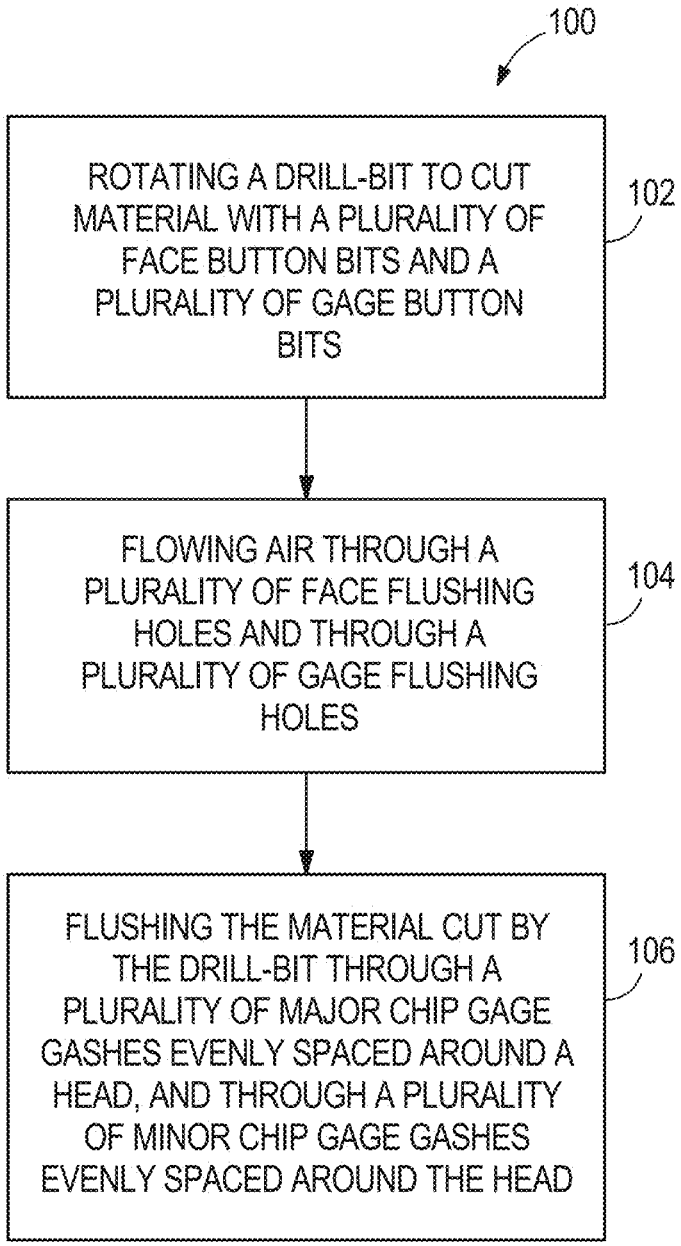
FIG. 4 is a flowchart illustrating one embodiment of a method of using a drill-bit.

FIG. 4 illustrates one embodiment of a method 100 of using a drill-bit. The method 100 may utilize any of the drill-bits of the disclosure. In other embodiments, the method 100 may utilize varying drill-bits. Step 102 may comprise rotating the drill-bit to cut material with a plurality of face button bits and a plurality of gage button bits. The plurality of gage button bits may be evenly spaced around a head of the drill-bit. Step 104 may comprise flowing air through a plurality of face flushing holes and through a plurality of gage flushing holes. Step 106 may comprise flushing the material cut by the drill-bit through a plurality of major chip gage gashes evenly spaced around the head, and through a plurality of minor chip gage gashes evenly spaced around the head. The plurality of major chip gage gashes may alternate with the plurality of minor chip gage gashes around the head. One of the plurality of gage button bits may be disposed in-between every set of the alternating major chip gage gashes and minor chip gage gashes. A first axis extending through centers of the plurality of face flushing holes may be perpendicular to a second axis extending through centers of the plurality of gage flushing holes.

In one embodiment, the face may comprise two face button bits and the gage may comprise six gage button bits.

In another embodiment, the face may consist of two face button bits and the gage may consist of six gage button bits.

In still another embodiment, one of the plurality of gage flushing holes may be disposed in one of the plurality of major chip gage gashes and another of the plurality of gage flushing holes may be disposed in one of the plurality of minor chip gage gashes.

In yet another embodiment, a third axis extending through centers of the plurality of face button bits may extend perpendicularly to the first axis extending through the centers of the plurality of face flushing holes.

In another embodiment, a slope of the face may be disposed at a non-parallel angle relative to a lateral axis of the drill-bit.

In other embodiments, one or more steps of the method 100 may be altered in substance or order, one or more steps of the method may not be followed, or one or more additional steps may be added.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true scope of the subject matter described herein. Furthermore, it is to be understood that the disclosure is defined by the appended claims. Accordingly, the disclosure is not to be restricted except in light of the appended claims and their equivalents.

What is claimed is:

1. A drill-bit comprising:

a head comprising a face and a gage;

the face comprising a plurality of face button bits;

the gage comprising a plurality of gage button bits evenly spaced around the head;

a plurality of major chip gage gashes evenly spaced around the head;

a plurality of minor chip gage gashes evenly spaced around the head;

an axis extending through centers of the plurality of face button bits extending through one of the plurality of major chip gage gashes and one of the plurality of minor chip gage gashes;

the plurality of major chip gage gashes alternating with the plurality of minor chip gage gashes around the head; and one of the plurality of gage button bits disposed in-between every set of the alternating major chip gage gashes and minor chip gage gashes.

2. The drill-bit of claim 1 wherein the face comprises two face button bits and the gage comprises six gage button bits.

3. The drill-bit of claim 1 wherein the face consists of two face button bits and the gage consists of six gage button bits.

4. The drill-bit of claim 1 further comprising a plurality of face flushing holes and a plurality of gage flushing holes.

5. The drill-bit of claim 4 wherein one of the plurality of gage flushing holes is disposed in one of the plurality of major chip gage gashes and another of the plurality of gage flushing holes is disposed in one of the plurality of minor chip gage gashes.

6. The drill-bit of claim 4 wherein the axis extending through the centers of the plurality of face button bits extends perpendicularly to a second axis extending through centers of the plurality of face flushing holes.

7. The drill-bit of claim 4 wherein a second axis extending through centers of the plurality of face flushing holes is perpendicular to a third axis extending through centers of the plurality of gage flushing holes.

8. The drill-bit of claim 1 wherein a slope of the face is disposed at a non-parallel angle relative to a lateral axis of the drill-bit.

9. A drill-bit comprising:

a head comprising a face and a gage;

the face comprising a plurality of face button bits;

the gage comprising a plurality of gage button bits evenly spaced around the head;

a plurality of major chip gage gashes evenly spaced around the head;

a plurality of minor chip gage gashes evenly spaced around the head;

a plurality of face flushing holes;

a plurality of gage flushing holes;

the plurality of major chip gage gashes alternating with the plurality of minor chip gage gashes around the head; and one of the plurality of gage button bits disposed in-between every set of the alternating major chip gage gashes and minor chip gage gashes;

wherein a first axis extending through centers of the plurality of face flushing holes is perpendicular to a second axis extending through centers of the plurality of gage flushing holes.

10. The drill-bit of claim 9 wherein the face comprises two face button bits and the gage comprises six gage button bits.

11. The drill-bit of claim 9 wherein the face consists of two face button bits and the gage consists of six gage button bits.

12. The drill-bit of claim 9 wherein one of the plurality of gage flushing holes is disposed in one of the plurality of major chip gage gashes and another of the plurality of gage flushing holes is disposed in one of the plurality of minor chip gage gashes.

13. The drill-bit of claim 9 wherein a third axis extending through centers of the plurality of face button bits extends perpendicularly to the first axis extending through the centers of the plurality of face flushing holes.

14. The drill-bit of claim 9 wherein a slope of the face is disposed at a non- parallel angle relative to a lateral axis of the drill-bit.

15. A method of using a drill-bit comprising:

rotating the drill-bit to cut material with a plurality of face button bits and a plurality of gage button bits, the plurality of gage button bits evenly spaced around a head of the drill-bit;

flowing air through a plurality of face flushing holes and through a plurality of gage flushing holes; and flushing the material cut by the drill-bit through a plurality of major chip gage gashes evenly spaced around the head, and through a plurality of minor chip gage gashes evenly spaced around the head, the plurality of major chip gage gashes alternating with the plurality of minor chip gage gashes around the head, one of the plurality of gage button bits disposed in-between every set of the alternating major chip gage gashes and minor chip gage gashes, and a first axis extending through centers of the plurality of face flushing holes being perpendicular to a second axis extending through centers of the plurality of gage flushing holes.

16. The method of claim 15 wherein the face comprises two face button bits and the gage comprises six gage button bits.

17. The method of claim 15 wherein the face consists of two face button bits and the gage consists of six gage button bits.

18. The method of claim 15 wherein one of the plurality of gage flushing holes is disposed in one of the plurality of major chip gage gashes and another of the plurality of gage flushing holes is disposed in one of the plurality of minor chip gage gashes.

19. The method of claim 15 wherein a third axis extending through centers of the plurality of face button bits extends perpendicularly to the first axis extending through the centers of the plurality of face flushing holes.

20. The method of claim 15 wherein a slope of the face is disposed at a non-parallel angle relative to a lateral axis of the drill-bit.

* * * * *